US005170766A

United States Patent [19]

Haas et al.

[11] Patent Number: 5,170,766

[45] Date of Patent: Dec. 15, 1992

[54] FUEL AND AIR INJECTION FOR MULTI-CYLINDER INTERNAL COMBUSTION ENGINES

[75] Inventors: Albert L. Haas, Cass City; Daniel E. Alsobrooks, Bay City; Oswald Baasch, Cass City, all of Mich.; John Carrico, Jondalup, Australia; Sam R. Leighton, Nedlands, Australia; Chris N. Sayer, Ferndale, Australia

[73] Assignee: Orbital Walbro Corporation, Cass City, Mich.

[21] Appl. No.: 821,628

[22] Filed: Jan. 16, 1992

[51] Int. Cl.[5] ..... F02M 23/00

[52] U.S. Cl. ..... 123/531

[58] Field of Search ..... 123/531, 532, 533, 445, 123/468, 585; 239/106, 112, 533.2, 5, 406, 410

[56] References Cited

U.S. PATENT DOCUMENTS

| | | | |
|---|---|---|---|
| 4,759,335 | 7/1988 | Ragg et al. | 123/531 |
| 4,781,164 | 11/1988 | Saaber et al. | 123/533 |
| 4,938,417 | 7/1990 | Halvorsen | 239/5 |
| 4,962,889 | 10/1990 | Halversen | 239/410 |
| 4,982,716 | 1/1991 | Takeda et al. | 123/531 |
| 5,024,202 | 6/1991 | McKay | 123/533 |
| 5,090,363 | 2/1992 | Duret | 123/531 |
| 5,102,054 | 4/1992 | Halvorsen | 239/533.2 |
| 5,115,786 | 5/1992 | Yamada | 123/531 |

*Primary Examiner*—Raymond A. Neill

*Attorney, Agent, or Firm*—Barnes, Kisselle, Raisch, Choate, Whittemore & Hulbert

[57] ABSTRACT

A fuel and air assembly is provided for furnishing an air and fuel mixture under pressure to a cylinder of an ignition fired internal combustion engine which utilized a solenoid-actuated valve timed to admit the mixture to the cylinder. A standard fuel injector is interfaced with one end of a mixing insert which is connected at the other end to an air passage of a fuel rail. At one side of the insert is an outlet passage leading to the solenoid actuated valve which has an outlet end shaped to enhance fuel distribution and combustion. The mixing insert contains an air filter and passages to conduct air to the common passage for air and fuel. The insert is captured in the fuel rail between a locating shoulder and the fuel injector for proper positioning relative to the timed valve. An adapter cap on the solenoid assembly joins the insert to the valve controlled passage to the cylinder.

18 Claims, 4 Drawing Sheets

FUEL AND AIR INJECTION FOR MULTI-CYLINDER INTERNAL COMBUSTION ENGINES

REFERENCE TO RELATED APPLICATION

Reference is made to a copending application of Albert L. Haas, Heiner W. Louis and Chris N. Sayer, entitled "Solenoid Winding Case and Protective Overmold and Method of Making", U.S. Ser. No. 07/736,252, filed Jul. 26, 1991.

FIELD OF INVENTION

Intermittent introduction of a fuel and air mixture through an electromagnetically operated valve directly into a combustion chamber of an internal combustion two-cycle engine.

BACKGROUND AND FEATURES OF THE INVENTION

Much development work has been done in connection with delivering fuel to internal combustion engines, in particular in recent years, the delivery of combustible fuel and gas, especially air, in metered quantities. Much of the work has centered around the delivery of a fuel mixture to two-cycle, spark ignition engines. U.S. Pat. No. 4,693,224 (Sep. 15, 1987) and U.S. Pat. No. 4,825,828 (May 2, 1989) illustrate and describe the problems of fuel injection and the advantages of direct in-cylinder injection which is effective in operation, economic to manufacture and achieves and maintains acceptable atomization of the fuel.

The present invention is specifically directed to internal combustion engines where a premetered quantity of fuel is entrained in a gas, conveniently air, and the fuel entrained in the gas is delivered directly into the combustion chamber of the engine through a nozzle which is intermittently opened. In one form this is achieved by the use of a poppet valve which is controlled and moved axially to open and closed positions using an electromagnetic coil and an armature closely associated with the poppet valve. Each cylinder, in a multi-cylinder engine, is provided with a fuel and air nozzle injection assembly.

As described in the above-referenced patents, the poppet valve has a cone-type configuration at the delivery end which influences the spray pattern of the injected fuel. The flow is axially along the outside of the poppet valve and is directed into a cylinder in a spray pattern by the conical surface at the delivery end. In the invention to be described, a standard fuel injection valve is utilized in connection with an air mixing element such that the mixture of fuel and air is delivered to the poppet valve for timed injection directly into an engine cylinder.

The features of the present invention involve a mounting of the poppet valve to an armature within the electromagnetic solenoid assembly to insure concentricity and squareness, and also a proper connection which will withstand the rapid reciprocation of the valve.

Another feature of the invention is the shape and contour of the poppet valve at the discharge end to avoid accumulation of unwanted residue which would interfere with proper operation.

Still another feature is the provision of a one-piece molded mixing insert which is positioned at the juncture of the incoming fuel, from a fuel injector, and the incoming air prior to the dual mixture traveling to the timed poppet and thence to the engine cylinder.

Additional objects and features of the invention will be apparent in the following description and claims in which the principles of the invention are set forth together with details to enable persons skilled in the art to practice the invention, all in connection with the best mode presently contemplated for the invention.

BRIEF DESCRIPTION OF THE DRAWINGS

Drawings accompany the disclosure and the various views thereof may be briefly described as.

BRIEF DESCRIPTION OF THE INVENTION

A fuel and gas assembly is provided for furnishing a gas and fuel mixture under pressure to a cylinder of an internal combustion engine which utilizes a solenoid assembly including a solenoid-actuated valve timed to admit the mixture to the cylinder. A fuel injector is interfaced with one end of a mixing insert which is connected at the other end to a gas passage of the fuel and gas assembly. At one side of the insert is an outlet passage leading to the solenoid actuated valve which has an outlet end shaped to enhance fuel distribution and combustion. The mixing insert contains an air filter and passages to conduct air to a common passage for air and fuel. The insert is positioned in an engine fuel rail between a locating shoulder and the fuel injector for proper positioning relative to the timed valve. An adapter cap on the solenoid assembly joins the mixing insert to a passage leading to the cylinder and which passage is controlled by the solenoid-actuated valve.

Detailed Description of the Invention and the Manner and Process of Making and Using It.

Figure 1:
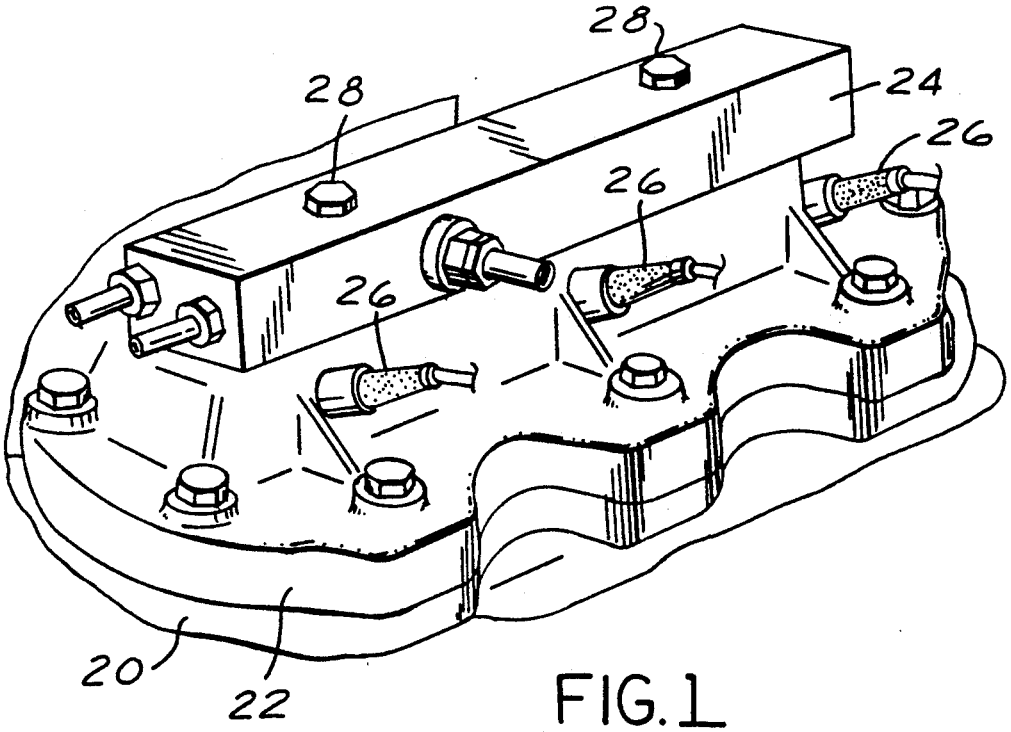
FIG. 1, a diagrammatic view of an engine head and fuel rail.

In FIG. 1 is illustrated a portion of an engine block 20 and engine cylinder head plate 22 carrying a diagrammatic view of a fuel rail 24 having suitable fuel and air inlets. Spark plugs 26 are shown extending into the cylinder head in a multi-cylinder engine. Hold down bolts 28 secure the fuel rail to the cylinder head.

Figure 3:
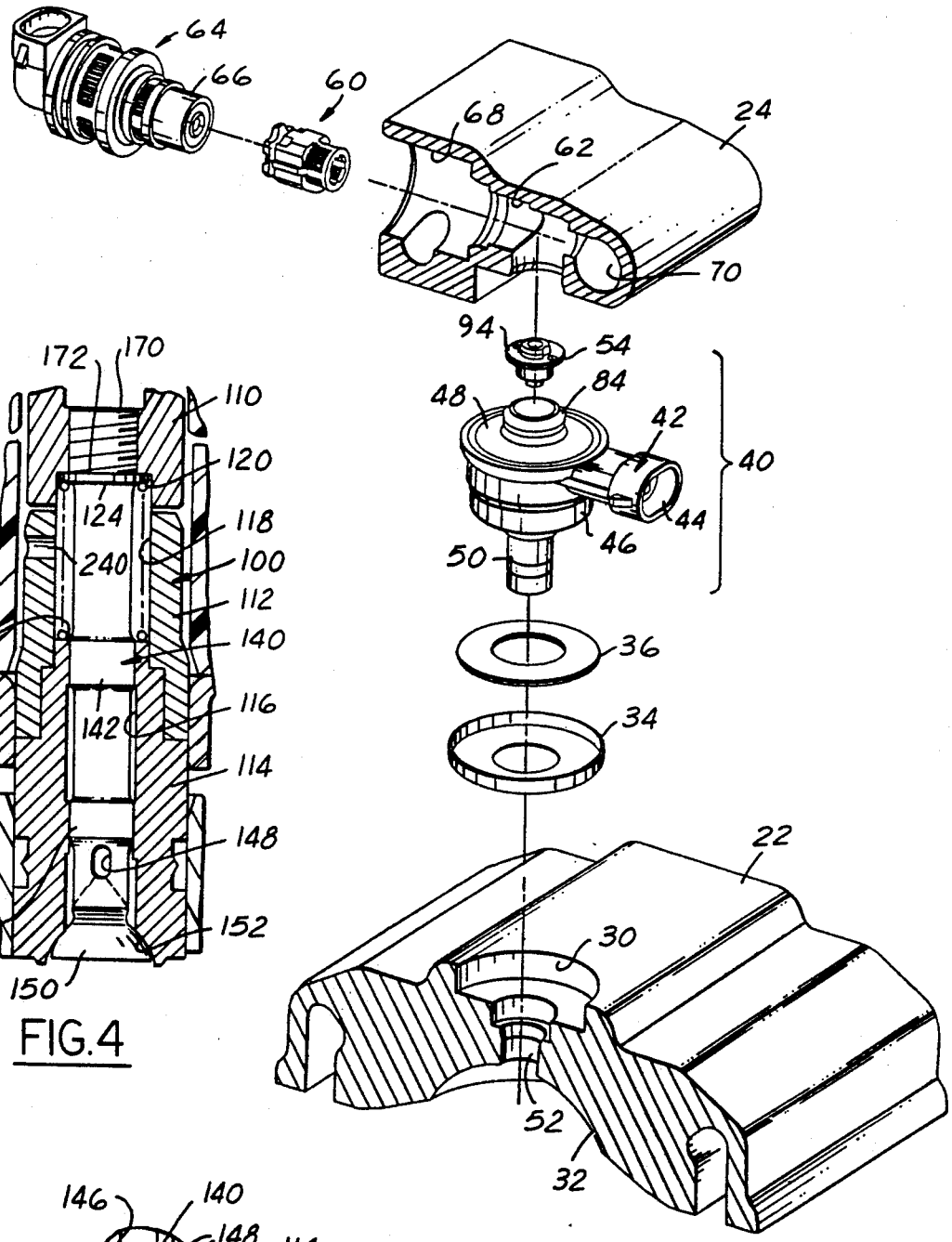
FIG. 3, an exploded view of the fuel injection assembly and electromagnetic actuator.

In FIG. 3, an exploded view illustrates the main parts in the assembly and these will be described prior to describing the details of the fuel delivery system. The engine cylinder head 22 has a stepped bore 30 above the top of a firing cylinder 32. The larger bore 30 is dimensioned to receive a cup solenoid washer-retainer 34 which carries a washer disc spring 36. An electromagnetic solenoid assembly 40 has a neck portion 42 with a recess 44 which receives electrical connections from a power source. The solenoid assembly comprises a cup housing 46 and a cover 48. A bottom projection 50 enters the lower bore 52. A solenoid assembly adapter cap 54 inserts into the top of the cover 48 and cooperates with a recess in the bottom of the fuel rail 24.

The fuel and air mixer insert 60 locates in a recess 62 in the fuel rail 24 and a fuel injector assembly 64 has a cylindrical nose portion 66 which slips into recess 62 in the fuel rail and functions with the insert 60.

Figure 2:
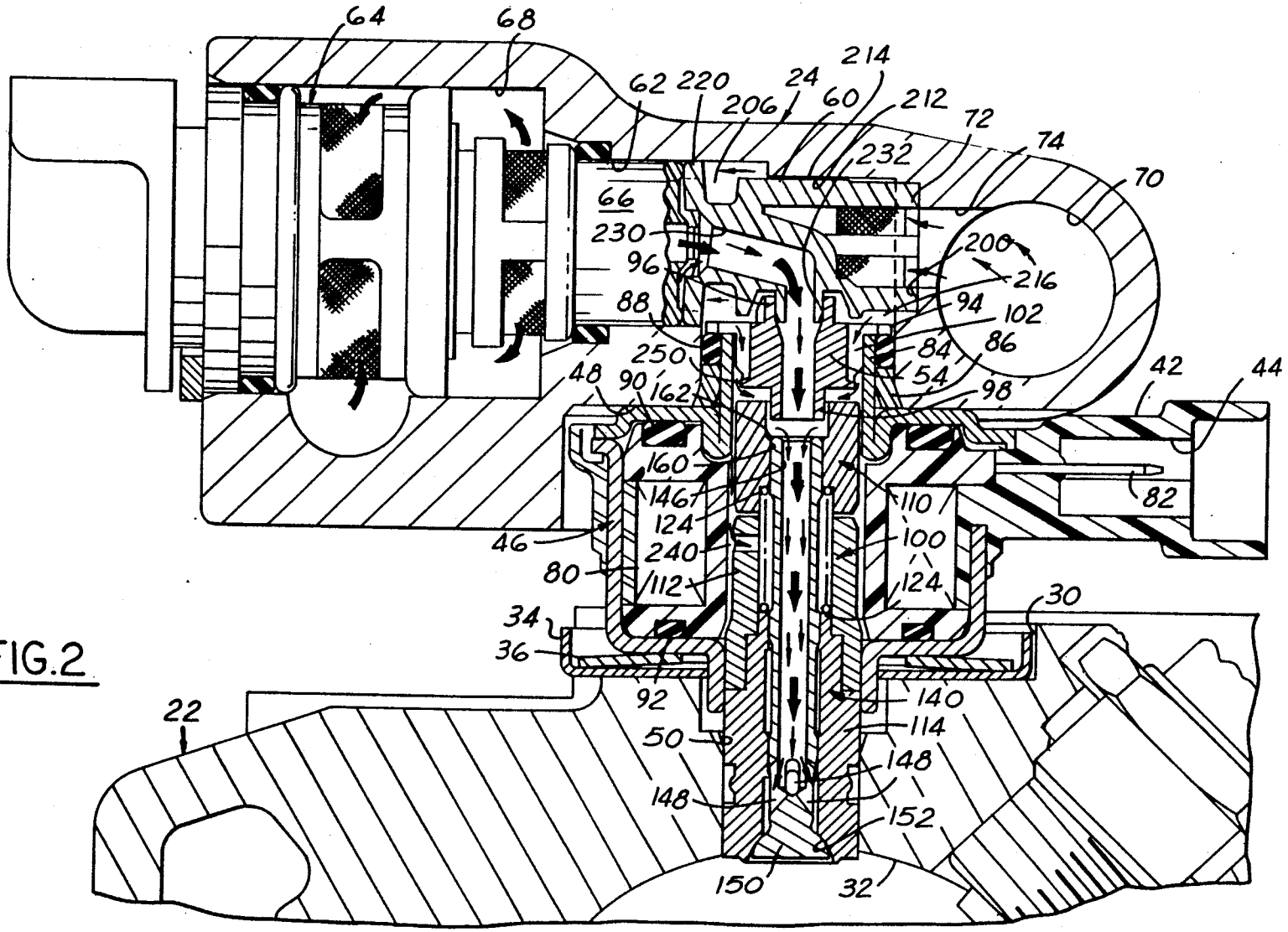
FIG. 2, a sectional view of an engine cylinder head and fuel rail showing the assembly of the mixing insert, the electromagnetic oil and armature, and the poppet valve stem.

Turning now to FIG. 2, the details of the electromagnetic solenoid unit are illustrated in connection with details of the fuel and air supply to the engine cylinder. A conventional fuel injector 64 in recess 68 has a nose portion 66 in recess 62. This injector interfaces with the mixer insert 60 interposed between the injector 66 and an air inlet 70 in the fuel rail 24. The insert 60 butts against a shoulder 72 at the inner end of passage 74 leading from the air inlet 70.

Below the fuel rail 24 and above the engine cylinder 22 is interposed an electromagnetic solenoid assembly seated on a disc spring 36 in the bottom of a cup 34 in recess 30 in the cylinder head 22. The solenoid assembly is composed of a cup element 46 and cover 48 which houses a coil winding 80 and which has contact projections 82 in the connector recess 44. The cover 48 has an upstanding neck portion 84 which projects into a recess in the bottom of the fuel rail, this neck portion being surrounded by a spacer ring 86 which supports an O-ring seal 88.

The coil winding 80 is encapsulated and sealed in the cup-cover housing 46,48 by O-rings 90 and 92. Press fitted within the neck 84 is a solenoid adapter cap 54 having a flange 94 resting on the top of the neck 84. This cap 54 has a top neck extension 96 which will interfit with the mixer insert 60, and a bottom neck portion 98 which extends into armature 110 and will function with a poppet valve 140 which is attached to the armature. The cap 54 has a through central passage connecting the two neck portions. The flange 94 has passages 102 which lead to a space around the neck portion 98 and into the top of the valve cartridge 100.

Figure 4:
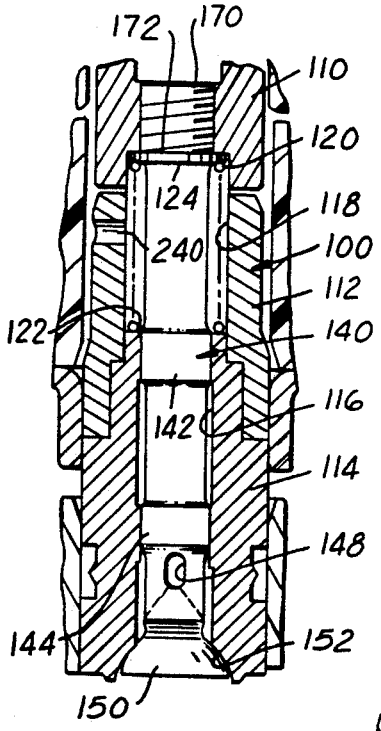
FIG. 4, an enlarged section of the poppet valve assembly.

Next to be described is the valve cartridge 100 and the poppet valve illustrated in FIGS. 2 and 4. Above the two-piece cartridge 100 is an armature 110 which has reciprocal motion between the cap 54 and the valve cartridge 100. The valve cartridge (FIG. 4) has a top unit 112 with a bottom recess telescoped over an ensmalled section of a bottom unit 114 to provide a single cartridge. A cylindrical bore 116 in the two units is slightly enlarged at 118 to accommodate a coil spring 120, one end of which seats on a shoulder 122 at the top of unit 114. The other end of the spring 120 seats on a shoulder 124 at the top of a poppet valve 140. The poppet valve 140 has two bearing lands 142,144 which slide in the bore 116 of the cartridge 100. A passage 146 extends through the valve body 140 and opens at the lower end through ports 148 to the outside of the poppet valve above a bulbous valve 150 end which cooperates with hemispherical recess 152 formed at the bottom end of the poppet valve 140 serving as a valve seat.

In FIG. 2, the top end of the poppet valve is secured to the armature 110 by a press fit into a recess 160 in the armature. Once the press fit assembly is accomplished, a weld 162 is applied to secure the parts together. It is important that the lower surface of the armature and the upper surface of part 112 be accurately normal to the axis of the valve 100 to insure no torquing or misalignment.

In FIG. 4, a modified attachment between the armature 110 and the poppet valve 140 is shown. In this embodiment, the top of the poppet valve has a threaded end 170 above a shoulder 172. With this assembly, the shoulder is accurately machined so that it has a flat annular surface perfectly normal to the axis of the valve. The threads are such that when the shoulder is screwed tight against the bottom surface of the armature, the shoulder will accurately position the parts in proper alignment.

There remains to be described the interface mixer element 60 which joins the gas or air supply passage 74, the injector nose 66, and the solenoid assembly cap 54. FIGS. 6 to 12 illustrate various views of this interface mixer insert which is molded out of material that is resistant to hydrocarbons and which has some flexibility to insure a proper fit when positioned.

Figure 6:
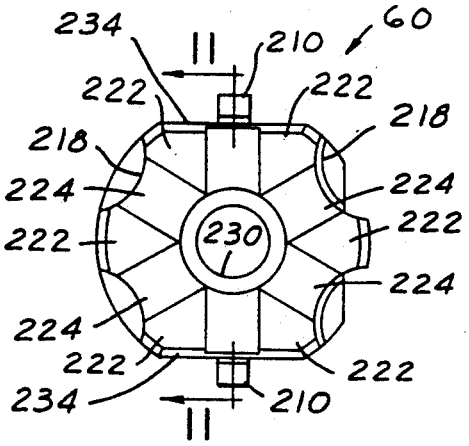
FIG. 6, an end view of a fuel and air mixer insert.
Figure 7:
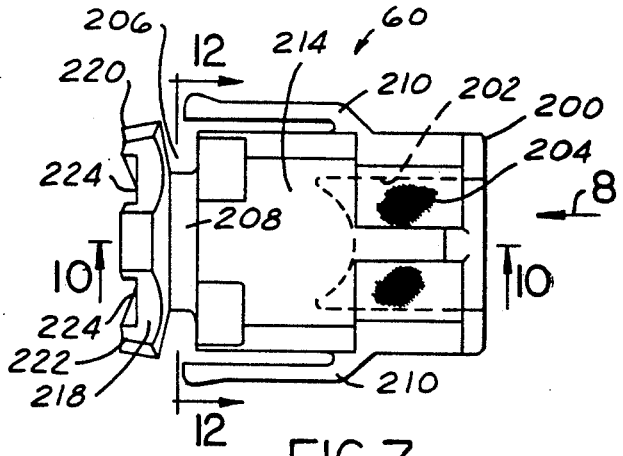
FIG. 7, a top elevation of the mixer insert.
Figure 10:
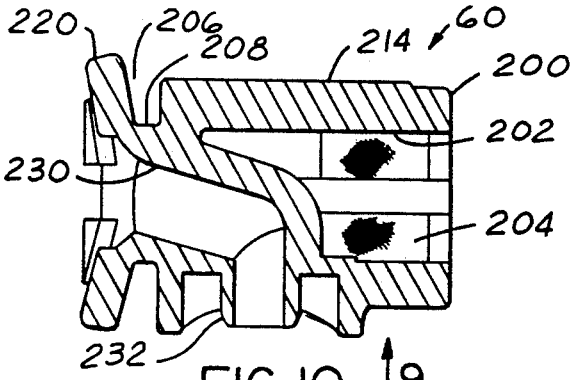
FIG. 10, a sectional view of the mixer insert on line 10—10 of FIG. 7.
Figure 8:
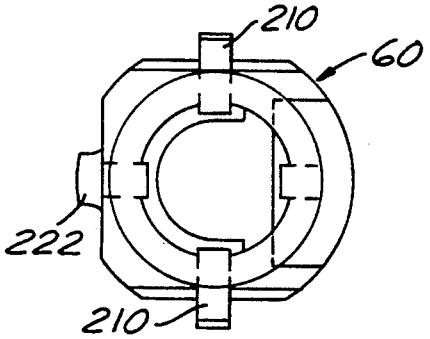
FIG. 8, an end view of the mixer insert at arrow 8 of FIG. 7.
Figure 12:
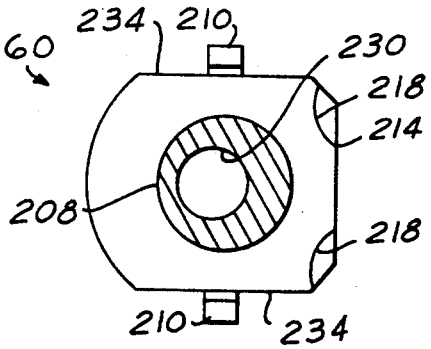
FIG. 12, a section on line 12—12 of FIG. 7.
Figure 9:
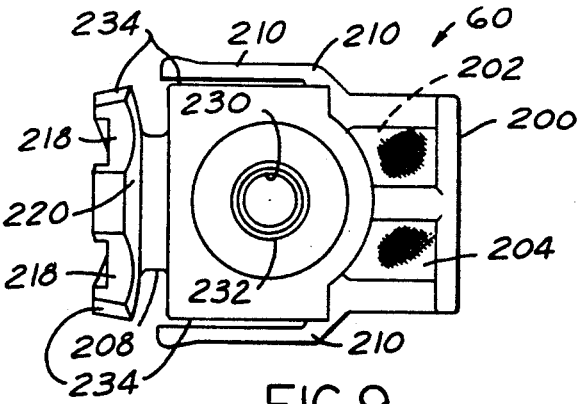
FIG. 9, a bottom view of the mixer insert at arrow 9 of FIG. 10.
Figure 11:
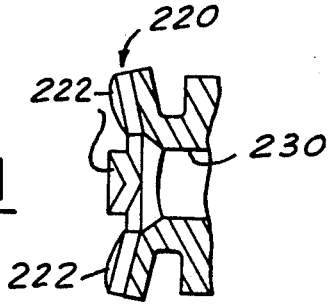
FIG. 11, a fragmentary section on line 11—11 of FIG. 6.

FIG. 7 is a top elevation view of the insert 60 while FIG. 6 is a view of the fuel injector end. FIG. 8 is a view of the air supply end at arrow 8 of FIG. 7. FIG. 9 is a bottom view of the insert at arrow 9 of FIG. 10. FIG. 10 is a sectioned view on line 10—10 of FIGS. 6 and 7. FIG. 11 is a partial section on line 11—11 of FIG. 6, and FIG. 12 is a section on line 12—12 of FIG. 7.

With reference to FIGS. 2 and 6 through 12, the air inlet end of the mixer insert 60 has an annular shoulder 200 which seats against an annular shoulder 72 at passage 74 in the fuel rail. Within the body of the insert is an air inlet chamber 202 which has an annular filter screen or mesh 204 to filter gas or air which can pass through the filters to the outside of the insert where it reaches an annular chamber 206 formed by necked down portion 208. The insert 60 has flexible legs 210 which contact the cylindrical recess 62 to space the walls of the insert from the walls of the recess 62, and to frictionally hold the insert in place in recess 62 during assembly of injector 64. The insert 60 has a flat indexing surface 214 that indexes with the flat surface 212 of the cylindrical recess 216. The indexing of the insert 60 allows the insert neck 232 to be oriented to accept the fit of the top neck extension 96 of the solenoid cap 54.

Looking now at the fuel injector end of the mixer insert 60, outside the neck portion 208 is a flexible dished shaped flange 220 with slotted radial passages 224. The radial passages cause the flange face surface to have spaced triangular shaped pads 222 on it. These pads 222 on the flexible flange 220 contact and are pressed inwardly by the end of the fuel injector nose 66. This puts pressure on the ring or collar 200 pressing it against the shoulder 72 in FIG. 2. Now looking at FIGS. 6 and 10, it will be seen that a fuel and air passage 230 originates with the radial passages 224 and curves downwardly to an outlet neck portion 232.

Air from the inlet passage 74 passes into the chamber 202 and through the filter 204 to the outside of insert 60 where it reaches the annular chamber 206 through the radiused notch-out areas 218 and flatted areas 234 and then through the radial passages 224 to reach the inlet end of passage 230.

The outlet neck portion of passage 232 enters the top neck extension 96 on the solenoid cap 54 in a snug fit. At the same time, some air from chamber 206 around the neck portion 208 can pass through openings 102 in solenoid cap 54 and pass around the lower outlet 98 of the solenoid cap and into the passage 146 of the poppet valve. This smaller quantity of air can scavenge any fuel which may drift into these areas and also fuel around armature 100. A lower radial passage 240 in the wall of the valve cartridge 110 allows this air to enter and scavenge fuel from the coil spring area and the area between the inside wall of the valve cartridge and the outside diameter of the poppet valve 140.

Thus, it will be seen that fuel from the fuel injector will enter passage 230 and reach the axial passage in the poppet 140 along with the air from the fuel rail 24 and passage 70. The injector 64 will be actuated to inject fuel at appropriate intervals in a known control circuit. The resilience of the pads on the flexible flange 220 will press the air inlet end of the insert securely against the shoulder 72 and thus avoid the need for accurate dimension axially of the insert.

FIG. 2, at the lower end of the solenoid cap 54 above the neck portion 98, has an annular ridge 250 which serves as a restricting dam to prevent fuel from blowing up into passage 102 when the armature rises by the action of the return spring 120. The air flow down passages 102 will scavenge fuel which bleeds by.

Figure 5:
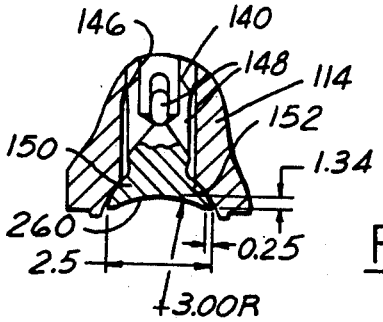
FIG. 5, a fragmentary view of the discharge end of the poppet valve.

The enlarged view in FIG. 4 shows the valve end 150 of the poppet 140 wherein actuation of the solenoid winding brings the armature down in a quick stroke to admit fuel and air into the cylinder of the engine. Because of the exposure to combustion heat, there may be a tendency to form carbon or other residue around the valve which will interfere with efficient operation. In FIG. 5, a modified end of the valve is illustrated wherein the cylinder side of the valve is shaped with a spherical recess 260. As an example, a valve end may have a rim 0.25 millimeters and the top of the arc is 1.34 millimeters from the lower rim. The arc of the recess is 3.00 millimeters. This configuration enhances the spray cone of the fuel and air mixture due to the Coanda effect. It reduces the carbon deposit on the valve head and provides a better spray cone distribution.

What is claimed is:

1. A fuel and gas assembly for delivering a fuel and gas mixture to a cylinder of an internal combustion engine which includes a fuel injector, a fuel rail, and a timed poppet valve which comprises:

(a) a fuel injector, (b) a rail having a gas passage and a first chamber to receive a fuel injector, a second adjacent chamber to receive a fuel and gas delivery insert, said second chamber being interposed between said first chamber and said gas passage, (c) said fuel and gas delivery insert having a first end adapted to receive a discharge end of said fuel injector, a second end of said insert opposed to said first end and being in communication with said gas passage, a recess formed in said second end in communication with the outside of said insert, passages in said insert to conduct air from said second end to said first end of said insert, and an outlet passage in said insert between said first and second ends to discharge fuel and gas mixture to a timed poppet valve.

2. A fuel and gas assembly as defined in claim 1 in which said fuel and gas delivery insert is a one-piece molded insert formed of an axial resilient plastic which is resistant to hydrocarbon fuel.

3. A fuel and gas assembly as defined in claim 1 in which said fuel and gas delivery insert has a recess at the first end to receive the discharge end of said fuel injector in a sealing relation.

4. A fuel and gas assembly as defined in claim 1 in which said second end of said insert has a chamber in communication with said gas passage at one end and in communication with said first end through passages around said insert whereby fuel and gas can mix at said first end and pass to said outlet passage.

5. A fuel and gas assembly as defined in claim 4 in which a gas filter is located in said chamber at the second end of said insert.

6. A fuel and gas assembly as defined in claim 1 in which a radial shoulder is formed at the gas inlet end of said second chamber to locate the second end of said insert.

7. A fuel and gas assembly as defined in clam 6 in which a flexible flange with pads on the first end of said insert is positioned to be contacted by said fuel injector to move said insert against said shoulder.

8. A fuel and gas assembly as defined in claim 7 in which said pads are circumferentially spaced around the insert and radial air channels are formed between said pads leading to a fuel and gas passage in said insert in communication with said outlet passage of said insert.

9. A fuel and gas assembly as defined in claim 1 in which circumferentially-spaced, axially-extending flexible legs on the outside of said insert serve to position said insert in said second chamber.

10. A fuel and gas assembly as defined in claim 1 in which a flat side on said insert registers with a flat side in said second chamber to orient said insert whereby said outlet passage is located to discharge to said poppet valve.

11. A fuel and gas assembly as defined in claim 1 in which said assembly includes a solenoid coil housing surrounding a valve housing with a central passage to house an armature and a valve, and an adapter between said coil housing and said insert having one end to connect to said outlet passage of said insert and a second end to register with the central passage of said solenoid coil housing.

12. A fuel and gas assembly as defined in claim 11 in which said solenoid coil housing has a cover with a raised collar centrally thereof and said adapter has an annular flange resting on said collar, and axial passages in said flange allows gas to flow through said passages to glean fuel into said central passage.

13. A fuel and gas assembly as defined in claim 12 in which an annular recess is formed around said adapter within said raised collar, and a fuel dam in the form of an annular ridge restrains upward flow of fuel into said annular recess.

14. A fuel and gas assembly as defined in claim 11 in which a poppet valve is movable axially in said central passage within the coil housing, and an armature is secured to the top of said poppet valve, said armature having a central recess telescoped over a portion of the poppet.

15. A fuel and gas assembly as defined in claim 14 in which said armature is press fitted over the top of said valve and welded in place.

16. A fuel and gas assembly as defined in claim 14 in which said valve has a threaded top portion above an annular flange formed thereon, and said armature is threaded on said valve against said flange.

17. A fuel and gas assembly as defined in claim 1 which includes an elongate, solenoid-actuated poppet valve having an axial passage for conducting fuel gas to an engine cylinder, a solenoid coil surrounding said valve, an armature adjacent said coil affixed to said valve and having a central passage in communication with said axial passage of said poppet valve, a valve seat formed at the base of said axial passage, a valve end in said poppet valve to cooperate with said valve seat, and radial passages extending out from said axial passage above said valve end to said valve seat to admit a fuel and gas mixture to said cylinder when said valve is actuated.

18. A fuel and gas assembly as defined in claim 17 in which said valve end below said radial passages is semi-spherical in shape and the end of said valve is formed with a spherical concavity extending to an annular edge of said valve end.

* * * * *